US010465967B2

(12) United States Patent
Besore et al.

(10) Patent No.: US 10,465,967 B2
(45) Date of Patent: Nov. 5, 2019

(54) REFRIGERATOR APPLIANCE WITH A CONVERTIBLE FREEZER COMPARTMENT

(71) Applicant: Haier US Appliance Solutions, Inc., Wilmington, DE (US)

(72) Inventors: John Keith Besore, Prospect, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 163 days.

(21) Appl. No.: 15/597,209

(22) Filed: May 17, 2017

(65) Prior Publication Data

US 2018/0335242 A1 Nov. 22, 2018

(51) Int. Cl.
*F25D 11/02* (2006.01)
*F25B 41/04* (2006.01)

(52) U.S. Cl.
CPC ..... *F25D 11/022* (2013.01); *F25B 41/04* (2013.01); *F25B 2600/2501* (2013.01); *F25B 2600/2507* (2013.01); *F25B 2600/2511* (2013.01); *F25D 2400/16* (2013.01)

(58) Field of Classification Search
CPC ..... F25D 1/022; F25D 2323/021; F25D 2400/16; F25D 17/065; F25B 41/04; F25B 2600/2501; F25B 2600/2507; F25B 2600/2511
See application file for complete search history.

(56) References Cited

U.S. PATENT DOCUMENTS

| | | | | |
|---|---|---|---|---|
| 8,191,382 | B2 | 6/2012 | Lim et al. | |
| 9,115,924 | B2 | 8/2015 | Leclear et al. | |
| 9,140,472 | B2 | 9/2015 | Shin et al. | |
| 2006/0130513 | A1 | 6/2006 | Chang et al. | |
| 2011/0146310 | A1* | 6/2011 | Kim | F25D 11/022 62/115 |
| 2013/0098077 | A1* | 4/2013 | Bonet | F25B 5/02 62/82 |
| 2014/0007611 | A1* | 1/2014 | Jeon | F25D 11/02 62/419 |
| 2016/0265833 | A1* | 9/2016 | Yoon | F25D 11/022 |

* cited by examiner

*Primary Examiner* — Elizabeth J Martin
(74) *Attorney, Agent, or Firm* — Dority & Manning, P.A.

(57) ABSTRACT

A refrigerator appliance with a freezer chamber divided into multiple compartments and features for selectively adjusting the temperature within one of the compartments while maintaining the temperature within the other compartment (s). The refrigerator can include evaporator including a first evaporator section and a second evaporator section, the first evaporator section positioned in a first evaporator chamber and the second evaporator section positioned in a second evaporator chamber. An evaporator shutoff valve is positioned along at least one of the first or second evaporator sections for selectively allowing fluid communication therebetween.

19 Claims, 12 Drawing Sheets

REFRIGERATOR APPLIANCE WITH A CONVERTIBLE FREEZER COMPARTMENT

FIELD OF THE INVENTION

The present subject matter relates generally to refrigerator appliances, and more particularly, to refrigerator appliances having convertible freezer compartments.

BACKGROUND OF THE INVENTION

Certain refrigerator appliances utilize sealed systems for cooling chilled chambers of the refrigerator appliances. A typical sealed system includes an evaporator and a fan. The fan generates a flow of air across the evaporator to cool the flow of air. The cooled air is then provided through an opening into the chilled chamber to maintain the chilled chamber at a desired set point temperature. Air from the chilled chamber is circulated back through a return duct to be re-cooled by the sealed system during operation of the refrigerator appliance, maintaining the chilled chamber at the desired temperature.

Certain refrigerators appliances include multiple freezer compartments configured for maintaining different temperatures for storing different types of food and drink items. For example, a conventional quad door bottom mount refrigerator can include a freezer chamber having two separate freezer compartments that are maintained at different temperatures. More specifically, a first freezer compartment may be maintained at a conventional freezer temperature (e.g., around 0° F.), while a second "convertible" freezer compartment may be adjusted between a conventional freezer temperature and relatively warm temperatures (e.g., between about 0° F. and 55° F.). A temperature of 55° F. within the warmed convertible freezer compartment may be useful for storing certain wines and other food items, for example.

However, achieving different temperatures in each of the compartments of such refrigerator appliances typically requires a separate evaporator for each compartment. In this regard, a single compressor may drive refrigerant through a switching mechanism to an evaporator configured for cooling a single compartment at a time. However, additional evaporators result in added costs, more complicated assembly, and a more complex refrigerant plumbing configuration. In addition, complicated switching mechanisms may be required or operational limitations may arise, e.g., only a single compartment may be cooled at a single time due to the shared compressor. Additionally, conventional refrigerator appliances typically include electric heaters for warming the convertible compartment to the desired set point temperature. Such electric heaters can be detrimental to energy performance.

Accordingly, a refrigerator appliance including a freezer chamber having a convertible compartment conditioned by an improved refrigeration system would be useful.

BRIEF DESCRIPTION OF THE INVENTION

The present subject matter provides a refrigerator appliance including a freezer chamber divided into multiple compartments, such as e.g., a first compartment and a second compartment. The refrigerator appliance includes features for conditioning the first and second compartments. In particular, the refrigerator appliance includes features for selectively adjusting the temperature within one of the compartments while maintaining the temperature within the other compartment(s). Additional aspects and advantages of the invention will be set forth in part in the following description, or may be apparent from the description, or may be learned through practice of the invention.

In one exemplary aspect, a refrigerator appliance is provided. The refrigerator appliance defines a vertical direction, a lateral direction, and a transverse direction, the vertical, lateral, and transverse directions being mutually perpendicular. The refrigerator appliance includes a cabinet that includes an inner liner defining a freezer chamber having a first freezer compartment and a second freezer compartment. The refrigerator appliance also includes a first evaporator cover positioned within the first freezer compartment to define a first evaporator chamber and a second evaporator cover positioned within the second freezer compartment to define a second evaporator chamber. The refrigerator appliance further includes an evaporator including a first evaporator section and a second evaporator section, the first evaporator section positioned in the first evaporator chamber and the second evaporator section positioned in the second evaporator chamber. Moreover, the refrigerator appliance includes an evaporator shutoff valve positioned along at least one of the first evaporator section and the second evaporator section for selectively allowing fluid communication between the first evaporator section and the second evaporator section.

In another exemplary aspect, a refrigerator appliance is provided. The refrigerator appliance defines a vertical direction, a lateral direction, and a transverse direction, the vertical, lateral, and transverse directions being mutually perpendicular. The refrigerator appliance includes a cabinet that includes an inner liner defining a freezer chamber having a first freezer compartment and a second freezer compartment. The refrigerator appliance also includes a first evaporator cover positioned within the first freezer compartment to define a first evaporator chamber and a second evaporator cover positioned within the second freezer compartment to define a second evaporator chamber. The refrigerator appliance further includes an evaporator including a first evaporator section and a second evaporator section, the first evaporator section positioned in the first evaporator chamber and the second evaporator section positioned in the second evaporator chamber. Moreover, the refrigerator appliance includes an evaporator shutoff valve positioned along at least one of the first evaporator section and the second evaporator section for selectively allowing fluid communication between the first evaporator section and the second evaporator section. In addition, the refrigerator appliance includes a secondary condenser positioned in at least one of the first evaporator chamber and the second evaporator chamber. Moreover, the refrigerator appliance also includes a condenser shutoff valve for selectively allowing a fluid flow through the secondary condenser.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
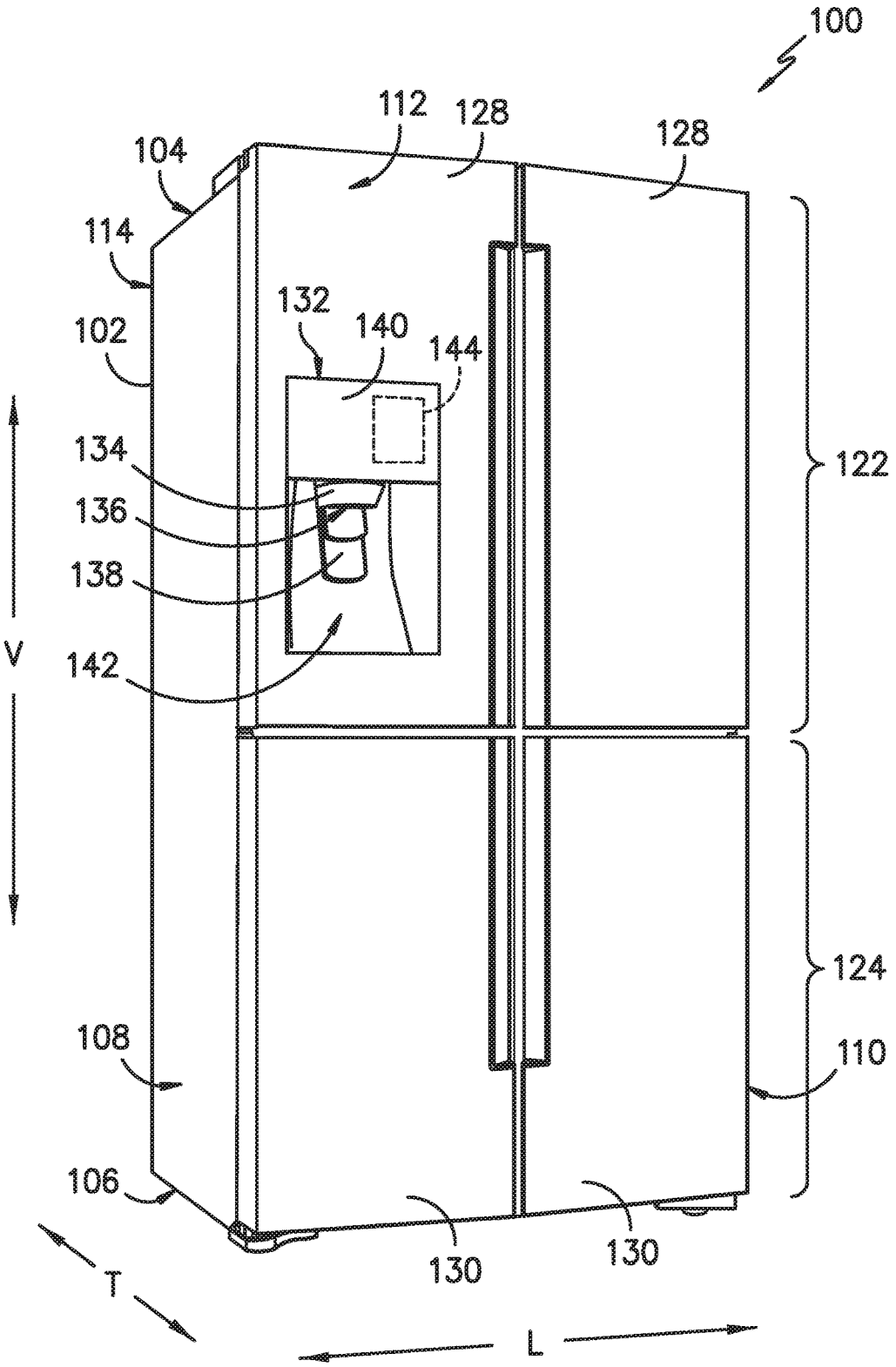
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

FIG. 1 provides a perspective view of a refrigerator appliance 100 according to an exemplary embodiment of the present subject matter. Refrigerator appliance 100 includes a housing or cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

Cabinet 102 defines chilled chambers for receipt of food items for storage. In particular, cabinet 102 defines fresh food chamber 122 positioned at or adjacent top 104 of cabinet 102 and a freezer chamber 124 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of cabinet 102 for selectively accessing fresh food chamber 122. Similarly, freezer doors 130 are rotatably hinged to an edge of cabinet 102 for selectively accessing freezer chamber 124. To prevent leakage of cool air, refrigerator doors 128, freezer doors 130, and/or cabinet 102 may define one or more sealing mechanisms (e.g., rubber gaskets, not shown) at the interface where the doors 128, 130 meet cabinet 102. Refrigerator doors 128 and freezer doors 130 are shown in the closed configuration in FIG. 1 and in the open configuration in FIG. 2. It should be appreciated that doors having a different style, position, or configuration are possible and within the scope of the present subject matter.

Refrigerator appliance 100 also includes a dispensing assembly 132 for dispensing liquid water and/or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of an adult user. According to an exemplary embodiment, the dispensing assembly 132 may receive ice from an icemaker disposed in a sub-compartment of the fresh food chamber 122.

Refrigerator appliance 100 further includes a controller 144. Operation of the refrigerator appliance 100 is regulated by controller 144 that is operatively coupled to control panel 140. In some exemplary embodiments, control panel 140 may represent a general purpose I/O ("GPIO") device or functional block. In some exemplary embodiments, control panel 140 may include input components, such as one or more of a variety of electrical, mechanical or electro-mechanical input devices including rotary dials, push buttons, touch pads, and touch screens. Control panel 140 can be communicatively coupled with controller 144 via one or more signal lines or shared communication busses. Control panel 140 provides selections for user manipulation of the operation of refrigerator appliance 100. In response to user manipulation of the control panel 140, controller 144 operates various components of refrigerator appliance 100. For example, controller 144 is operatively coupled or in communication with various components of a sealed system, as discussed below. Controller 144 may also be communicatively coupled with a variety of sensors, such as, for example, chamber temperature sensors or ambient temperature sensors. Controller 144 may receive signals from these temperature sensors that correspond to the temperature of an atmosphere or air within their respective locations.

Controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
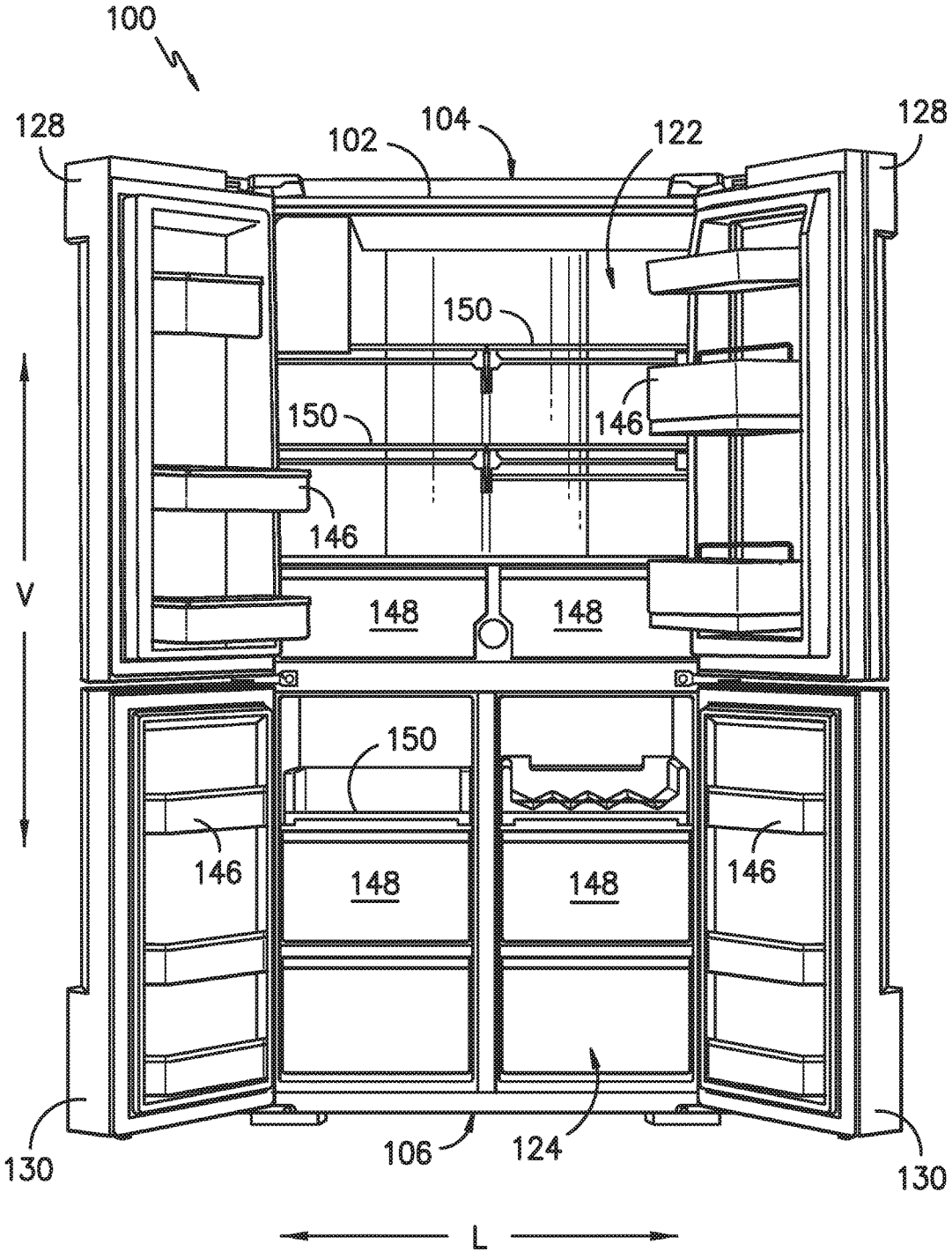
FIG. 2 provides a front view of the exemplary refrigerator appliance of FIG. 1 with the refrigerator and freezer doors of the refrigerator appliance shown in an open position.

FIG. 2 provides a front view of refrigerator appliance 100 with refrigerator doors 128 and freezer doors 130 shown in an open position. According to the illustrated embodiment, various storage components are mounted within fresh food chamber 122 and freezer chamber 124 to facilitate storage of food items therein as will be understood by those skilled in the art. In particular, the storage components include bins 146, drawers 148, and shelves 150 that are mounted within fresh food chamber 122 or freezer chamber 124. Bins 146, drawers 148, and shelves 150 are configured for receipt of food items (e.g., beverages and/or solid food items) and may assist with organizing such food items. As an example, drawers 148 of fresh food chamber 122 can receive fresh food items (e.g., vegetables, fruits, and/or cheeses) and increase the useful life of such fresh food items.

Figure 3:
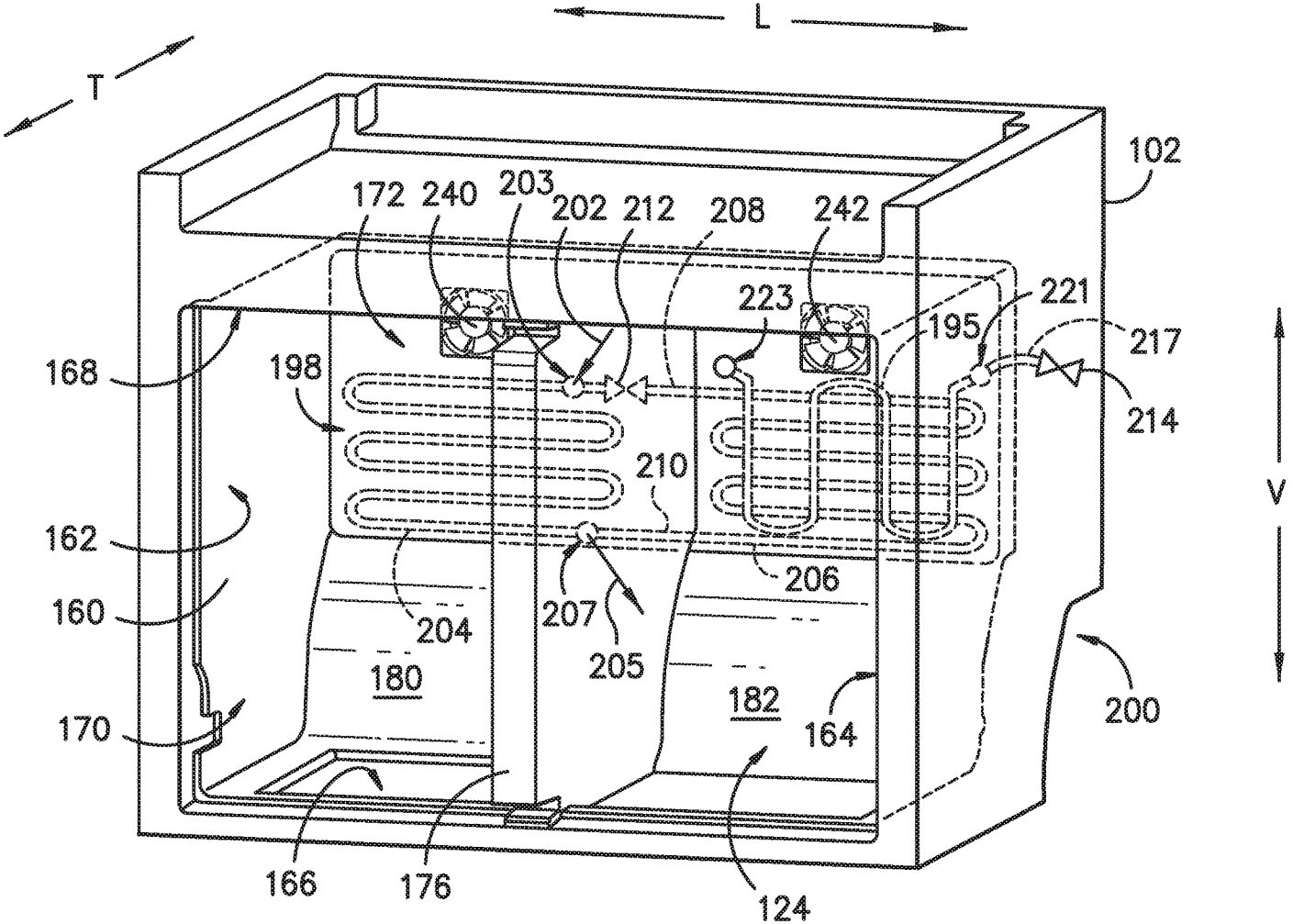
FIG. 3 provides a perspective view of a freezer chamber of the exemplary refrigerator appliance of FIG. 1 with the freezer doors and storage bins removed for additional clarity according to an exemplary embodiment of the present subject matter.

FIG. 3 provides a perspective view of freezer chamber 124 of the exemplary refrigerator appliance of FIG. 1 with freezer doors 130 and storage bins 146 removed for additional clarity. As shown, cabinet 102 includes an inner liner 160 which defines freezer chamber 124. For example, inner liner 160 may be an injection-molded door liner attached to an inside of cabinet 102. Insulation (not shown), such as expandable foam can be present between cabinet 102 and inner liner 160 in order to assist with insulating freezer chamber 124. For instance, sprayed polyurethane foam may be injected into a cavity defined between cabinet 102 and inner liner 160 after they are assembled. Freezer doors 130 (FIGS. 1 and 2) may be constructed in a similar manner to assist in insulating freezer chamber 124.

Freezer chamber 124 generally extends between a left wall 162 and a right wall 164 along the lateral direction L, between a bottom wall 166 and a top wall 168 along the vertical direction V, and between a chamber opening 170 defined by cabinet 102 and a back wall 172 along the transverse direction T. Refrigerator appliance 100 further includes a mullion 176 positioned within freezer chamber 124 to divide freezer chamber 124 into a first freezer compartment 180 and a second freezer compartment 182. According to the illustrated embodiment, mullion 176 generally extends between chamber opening 170 and back wall 172 along the transverse direction T and between bottom wall 166 and top wall 168 along the vertical direction V. Moreover, mullion 176 has a thickness along the lateral direction L. In this manner, mullion 176 is generally vertically-oriented and splits freezer chamber 124 into two equally-sized compartments 180, 182.

To limit heat transfer between first freezer compartment 180 and second freezer compartment 182, mullion 176 may generally be formed from an insulating material such as foam. In addition, to provide structural support, a rigid injection molded liner or a metal frame may surround the insulating foam. According to another exemplary embodiment, mullion 176 may be a vacuum insulated panel or may contain a vacuum insulated panel to minimize heat transfer between first freezer compartment 180 and second freezer compartment 182. According to an exemplary embodiment, inner liner 160 and/or mullion 176 may include features such as guides or slides, e.g., to ensure proper positioning, installation, and sealing of mullion 176 within inner liner 160.

A seal, such as a rubber or foam gasket (not shown), may be positioned around a perimeter of mullion 176 where it contacts inner liner 160 and/or freezer doors 130. In addition, mullion 176 can be formed to have the same shape as inner liner 160 such that a tight seal is formed when mullion 176 is installed. However, as further described below, mullion 176 may further include recesses, apertures, or passageways where needed to allow refrigeration system components to pass through mullion 176. Although mullion 176 is illustrated as extending vertically through a middle of freezer chamber 124, it should be appreciated that mullion 176 may be sized, positioned, and configured in any suitable manner to form separate freezer sub-compartments within freezer chamber 124.

Figure 4:
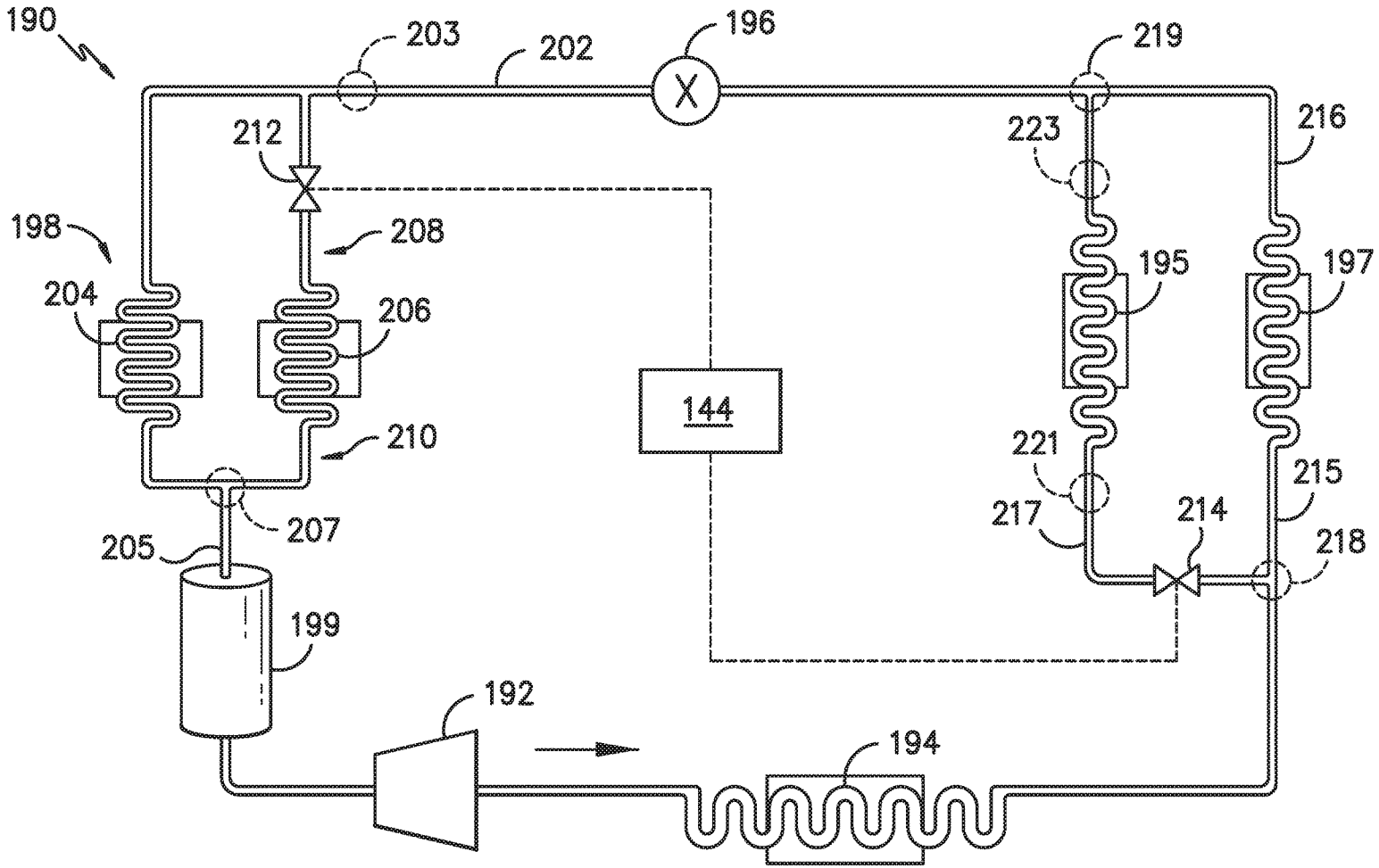
FIG. 4 provides a schematic view of a sealed system configured for conditioning the exemplary freezer chamber of FIG. 3 according to an exemplary embodiment of the present subject matter.

FIG. 4 provides a schematic view of an exemplary sealed system 190 of the refrigerator appliance 100 of FIG. 3 for conditioning the air within freezer chamber 124. Sealed system 190 is generally configured for executing a vapor compression cycle for cooling air within refrigerator appliance 100, e.g., within freezer chamber 124. As shown, sealed cooling system 190 includes a compressor 192, a primary condenser 194, an expansion device 196, and an evaporator 198 in a serial flow fluid communication and charged with a refrigerant, such as e.g., R134*a*.

Generally, during operation of sealed system 190, gaseous refrigerant flows into compressor 192, which operates to increase the pressure of the refrigerant. This compression of the refrigerant raises its temperature, which is lowered by passing the gaseous refrigerant through primary condenser 194. Within primary condenser 194, heat exchange with ambient air takes place so as to cool the refrigerant and cause the refrigerant to condense to a liquid state.

Expansion device 196 (e.g., a valve, capillary tube, or other restriction device) receives liquid refrigerant from primary condenser 194. From expansion device 196, the liquid refrigerant enters evaporator 198. Upon exiting expansion device 196 and entering evaporator 198, the liquid refrigerant drops in pressure and vaporizes. Due to the pressure drop and phase change of the refrigerant, evaporator 198 is cool relative to freezer chamber 124 of refrigerator appliance 100. As such, cooled air is produced and chills freezer chamber 124 of refrigerator appliance 100. Thus, evaporator 198 is a type of heat exchanger which transfers heat from air passing over evaporator 198 to refrigerant flowing through evaporator 198.

It should be appreciated that the illustrated sealed system 190 is only one exemplary configuration of sealed system 190 and that sealed system 190 can include additional components, e.g., one or more additional evaporators, compressors, expansion devices, and/or condensers. As an example, sealed system 190 may include an accumulator 199. Accumulator 199 may be positioned downstream of evaporator 198 and may be configured to collect condensed refrigerant from the refrigerant stream prior to passing it to compressor 192.

Returning to FIG. 3, as shown for this embodiment, evaporator 198 is positioned adjacent back wall 172 of inner liner 160. The remaining components of sealed system 190 are typically located within a machinery compartment 200 of refrigerator appliance 100. An evaporator inlet conduit 202 may pass refrigerant into freezer chamber 124 to evaporator 198 through a fluid tight evaporator inlet 203 and an evaporator outlet conduit 205 may pass refrigerant from evaporator 198 out of freezer chamber 124 through a fluid tight evaporator outlet 207.

Figure 5:
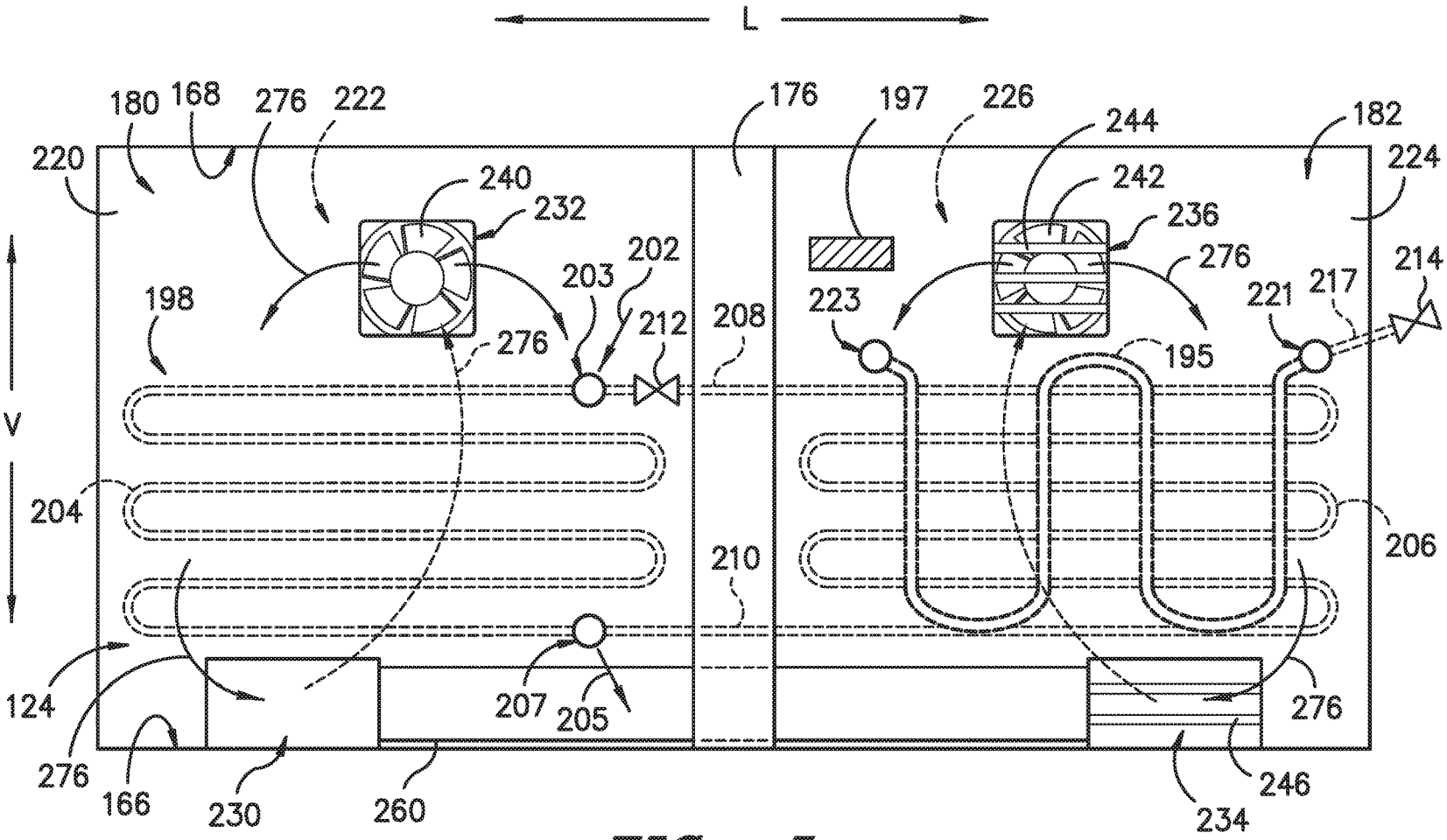
FIG. 5 provides a front, schematic view of the exemplary freezer chamber of FIG. 3 with the freezer doors and storage bins removed for additional clarity according to an exemplary embodiment of the present subject matter.

FIG. 5 provides a front view of freezer chamber 124 of FIG. 3 with freezer doors 130 and storage bins 146 removed for additional clarity. As shown, evaporator 198 includes a first evaporator section 204 and a second evaporator section 206. For this embodiment, first evaporator section 204 and second evaporator section 206 are in fluid communication and are connected in parallel. More specifically, first evaporator section 204 and second evaporator section 206 are coupled by a first transition conduit 208 positioned proximate evaporator inlet 203. Moreover, first evaporator section 204 and second evaporator section 206 are also coupled by a second transition conduit 210 positioned proximate evaporator outlet 207. First and second transition conduits 208, 210 may be a separate connecting conduit or a part of the same tube forming evaporator 198. For this embodiment, first evaporator section 204 is positioned within first freezer compartment 180 and second evaporator section 206 is positioned within second freezer compartment 182. In this regard, first and second transition conduits 208, 210 may pass through an aperture defined in mullion 176.

An evaporator cover is typically placed over evaporator 198 to form an evaporator chamber with inner liner 160. For example, as illustrated in FIG. 5, a first evaporator cover 220 is positioned within first freezer compartment 180 over evaporator 198, or more specifically, over first evaporator section 204. In this manner, inner liner 160, mullion 176, and first evaporator cover 220 define a first evaporator chamber 222 which houses first evaporator section 204. Similarly, a second evaporator cover 224 is positioned within second freezer compartment 182 over evaporator 198, or more specifically, over second evaporator section 206. In this manner, inner liner 160, mullion 176, and second evaporator cover 224 define a second evaporator chamber 226 which houses second evaporator section 206.

Evaporator chambers 222, 226 generally include one or more return ducts and supply ducts to allow air to circulate to and from first freezer compartment 180 and second freezer compartment 182. For this embodiment, first evaporator cover 220 defines a first return duct 230 for allowing air to enter first evaporator chamber 222 and a first supply duct 232 for exhausting air out of first evaporator chamber 222 into first freezer compartment 180. Similarly, second evaporator cover 224 defines a second return duct 234 for allowing air to enter second evaporator chamber 226 and a second supply duct 236 for exhausting air out of second evaporator chamber 226 into second freezer compartment 182. For this embodiment, first return duct 230 and second return duct 234 are positioned proximate a bottom of freezer chamber 124 (e.g., proximate bottom wall 166) and first supply duct 232 and second supply duct 236 are positioned proximate a top of freezer chamber 124 (e.g., proximate top wall 168). It should be appreciated that in some embodiments, however, any other suitable means for providing fluid communication between the evaporator chambers and the freezer compartments are possible and within the scope of the present subject matter.

As further shown in FIG. 5, refrigerator appliance 100 includes one or more fans to assist in circulating air through evaporator 198 and chilling freezer compartments 180, 182. For example, for this embodiment, refrigerator appliance 100 includes a first fan 240 in fluid communication with first evaporator chamber 222 for urging air through first evaporator chamber 222. More specifically, first fan 240 may be an axial fan positioned within first supply duct 232 for urging chilled air from first evaporator chamber 222 into first freezer compartment 180 through first supply duct 232 while recirculating air through first return duct 230 back into first evaporator chamber 222 to be re-cooled. Similarly, refrigerator appliance 100 includes a second fan 242 in fluid communication with second evaporator chamber 226 for urging air through second evaporator chamber 226. More specifically, second fan 242 may be an axial fan positioned within second supply duct 236 for circulating air between second evaporator chamber 226 and second freezer compartment 182, as described above.

Cooling airflow is indicated by arrows 276, with dotted lines indicating the airflow behind first evaporator cover 220 and second evaporator cover 224. As shown, first fan 240 urges chilled air from first evaporator chamber 222 into first freezer compartment 180. After cooling first freezer compartment 180, air is drawn back into first evaporator chamber 222 through first return duct 230 where it is drawn through first evaporator section 204 of evaporator 198. The air is chilled by evaporator 198 and then recirculated into first freezer compartment 180. A similar process occurs in second freezer compartment 182.

Even when fans 240, 242 are not actively circulating chilled air, air may enter freezer compartments 180, 182 through ducts 230, 232, 234, and/or 236. In certain situations, such as when second freezer compartment 182 is being maintained at relatively high temperatures, it may be desirable to stop this unintended flow of chilled air. Therefore, refrigerator appliance 100 may also include one or more damper assemblies configured for selectively opening and closing the supply and return ducts. For example, as shown in FIG. 5, a supply damper 244 can be operably coupled to second supply duct 236 and a return damper 246 can be operably coupled with second return duct 234. In this manner, the supply and return dampers 244, 246 may be selectively opened and closed to allow or block the flow of cooling air into second freezer compartment 182. It should be appreciated that first freezer compartment 180 could also include supply and return dampers to selectively block the flow of cooling air as well.

In some embodiments, it may be desirable to raise the temperature of second freezer compartment 182 from a conventional freezer temperature (e.g., around 0° F.) to temperatures close to those of fresh food chamber 122 (e.g., around or above 37° F.), and in some instances, it may be desirable to raise the temperature of second freezer compartment 182 such that it may reach and maintain relatively high temperatures (e.g., up to about 55° F.). A temperature of 55° F. within second freezer compartment 182 may be useful for storing certain wines and other food items, for example. As second freezer compartment 182 is adjustable between conventional freezer temperatures and relatively warm freezer temperatures, second freezer compartment 182 may be designated as a "convertible" freezer chamber.

Referring now to FIGS. 3, 4 and 5, an exemplary embodiment of sealed system 190 that allows for adjustment of second freezer compartment 182 between conventional freezer temperatures and relatively high temperatures will be described. As shown in FIG. 4, refrigerant is delivered to evaporator 198 from expansion device 196 via evaporator inlet conduit 202. The refrigerant enters evaporator 198 through evaporator inlet 203. For this embodiment, evaporator inlet 203 is positioned within first evaporator chamber 222 of first freezer compartment 180 as shown in FIG. 5. In some embodiments, evaporator inlet 203 can be positioned within second evaporator chamber 226 of second freezer compartment 182.

Figure 10:
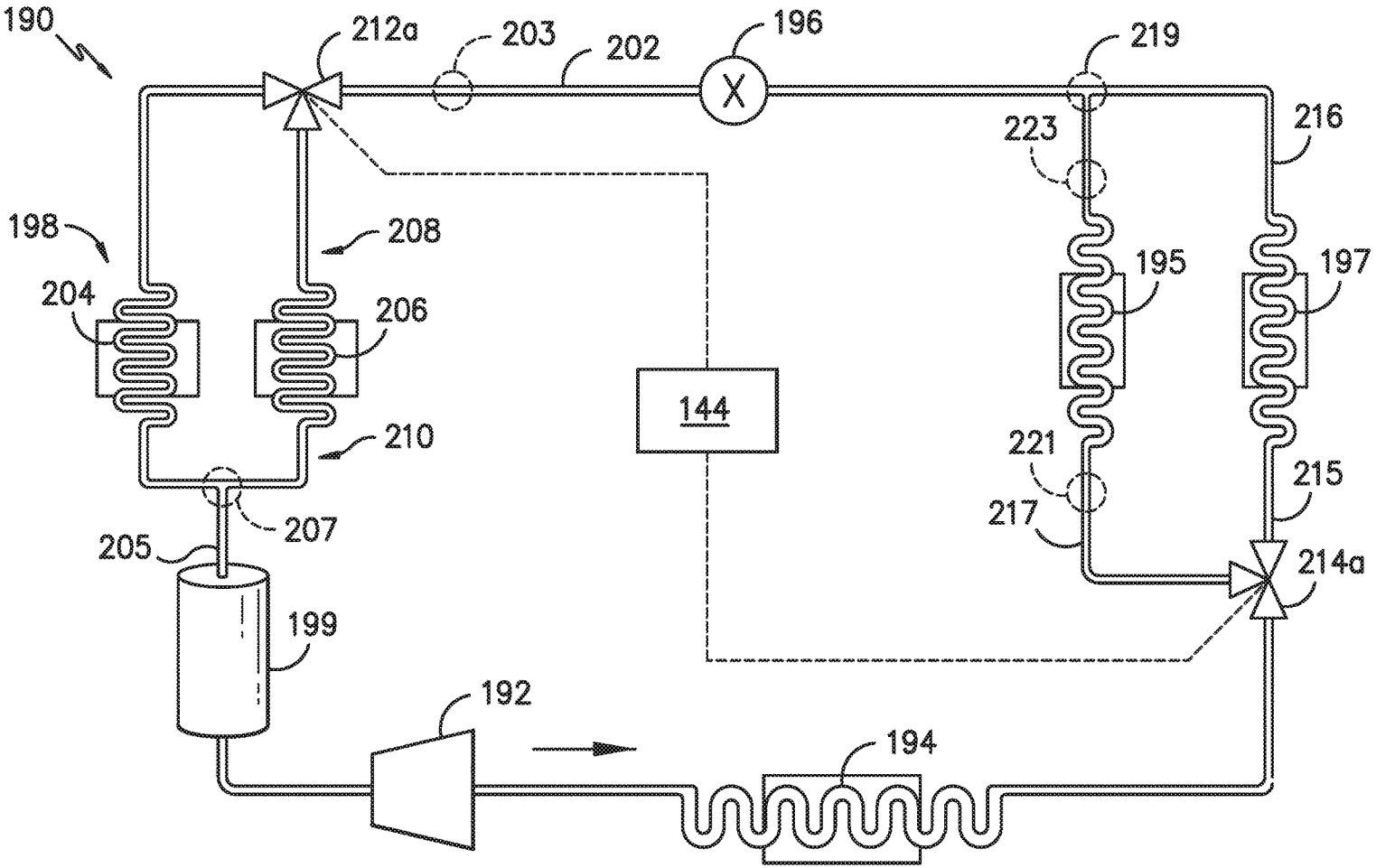
FIG. 10 provides a schematic view of yet another exemplary embodiment of sealed system configured for conditioning the exemplary freezer chamber of the exemplary refrigerator appliance of FIG. 1.

As further shown in FIG. 5, sealed system 190 includes an evaporator shutoff valve 212. For this embodiment, evaporator shutoff valve 212 is positioned along first evaporator section 204 of evaporator 198 for selectively allowing fluid communication between first evaporator section 204 and second evaporator section 206 (FIG. 5). Moreover, as shown, evaporator shutoff valve 212 is positioned proximate evaporator inlet 203. When it is desired to maintain second freezer compartment 182 at a conventional freezer temperature (e.g., 0° F.), evaporator shutoff valve 212 is articulated to an open position to allow refrigerant to flow into second evaporator section 206. In this manner, as cooling airflow 276 passes through second evaporator section 206, the air is chilled to conventional freezer temperatures and circulated into second freezer compartment 182 in the manner described above. When it is desired to convert second freezer compartment 182 into a warmed compartment, evaporator shutoff valve 212 is articulated to a closed position to prevent refrigerant from flowing into second evaporator section 206. In this way, airflow 276 passing through second evaporator section 206 is not chilled. In some embodiments, evaporator shutoff valve 212 can be an evaporator three way valve 212*a* (FIG. 10). Such a three way valve can provide a closed position that reduces refrigerant cycling losses.

As shown in FIG. 4, evaporator shutoff valve 212 is communicatively coupled with controller 144. When a user selects a set point temperature indicative of a conventional freezer temperature, controller 144 can send one or more signals and evaporator shutoff valve 212 can receive the one or more signals to open evaporator shutoff valve 212. Based at least in part on these signals, evaporator shutoff valve 212 can be articulated to an open position (or evaporator three way valve 212*a* can be configured to allow flow into both first and second evaporator sections 204, 206 (FIG. 10)), thereby allowing refrigerant to flow into second evaporator section 206 to ultimately cool second freezer compartment 182. In contrast, when a user selects a set point temperature indicative of any non-conventional freezer temperature (e.g., a relatively high temperature of 55° F. or a conventional fresh food temperature of 37° F.), controller 144 can send one or more signals and evaporator shutoff valve 212 can receive the one or more signals to close evaporator shutoff valve 212. Based at least in part on these signals, evaporator shutoff valve 212 can be articulated to a closed position. As a result, refrigerant ceases to flow into second evaporator section 206 thereby allowing second freezer compartment 182 to be warmed to the set point temperature.

As further shown in FIG. 5, for this embodiment, evaporator shutoff valve 212 is positioned within the same evaporator chamber as evaporator inlet 203. That is, for this embodiment, evaporator shutoff valve 212 and evaporator inlet 203 are both positioned within first evaporator chamber 222. In this way, if evaporator shutoff valve 212 is articulated to a closed position (i.e., when it is desired to warm second freezer compartment 182), refrigerant does not flow into the chamber, which in this embodiment is second freezer compartment 182, if the chamber is set to a warm set point temperature. This may allow for second freezer compartment 182 to more quickly reach the selected warmer set point temperature.

In some embodiments, evaporator inlet 203 is positioned in first evaporator chamber 222 and evaporator shutoff valve 212 is positioned in second evaporator chamber 226 along second evaporator section 206. In such embodiments, it is advantageous for evaporator shutoff valve 212 to be positioned proximate first transition conduit 208. While some refrigerant may be allowed to flow into second evaporator section 206 positioned within second evaporator chamber 226 of second freezer compartment 182 in such embodiments, the amount of refrigerant entering and extending into second evaporator section 206 can be limited by placing evaporator shutoff valve 212 proximate first transition conduit 208. In this way, second freezer compartment 182 is not inadvertently cooled when it is desired to warm the compartment.

In addition, as further shown in FIG. 5, in the event refrigerant is flowing through second evaporator section 206 (i.e., when conventional freezer temperatures are desired in second freezer compartment 182), the refrigerant flows back to first evaporator chamber 222 via second transition conduit 210. Once the refrigerant has returned to first evaporator chamber 222, the refrigerant exits evaporator 198 through evaporator outlet 207. The refrigerant then flows through an evaporator outlet conduit 205 to accumulator 199, as shown more particularly in FIG. 4. Notably, for this embodiment, evaporator inlet 203 and evaporator outlet 207 are both positioned within the same evaporator chamber. More particularly, evaporator inlet 203 and evaporator outlet 207 are both positioned in first evaporator chamber 222. In this way, the refrigerant flowing through second freezer compartment 182 can be minimized in the event evaporator shutoff valve 212 is in the closed position. Stated alternatively, where evaporator outlet 207 is positioned within the same chamber as evaporator inlet 203, after the refrigerant flows through first evaporator section 204, the refrigerant does not enter the other freezer chamber.

Moreover, as further shown in FIG. 5, for this embodiment, evaporator inlet 203, evaporator outlet 207, and evaporator shutoff valve 212 are all positioned within the same chamber. In this way, when it is desired to warm second freezer compartment 182, refrigerant can be completely prevented from flowing through second evaporator section 206 positioned within second freezer compartment 182. This may allow for second freezer compartment 182 to warm to the desired set point temperature faster.

Referring still to FIGS. 3, 4, and 5, to warm convertible second freezer compartment 182, for this embodiment, refrigerator appliance 100 further includes a secondary condenser 195 positioned in second evaporator chamber 226 as shown in FIG. 5. Secondary condenser 195 can be a geometry of tubing that is attached to the rear refrigerator wall behind evaporator 198. Secondary condenser 195 can be attached to an aluminum foil for attachment and additional surface area. For this embodiment, secondary condenser 195 is a spine fin coil extending at least partially through second evaporator chamber 226. The geometry of the spine fin coil configuration can significantly reduce the length of coil required to produce a desired heat output and thus such a configuration is advantageous when space within the evaporator chamber is limited. The spine fin coil configuration can have other advantages as well. In some embodiments, secondary condenser 195 can be any suitable aluminum foil shape extending at least partially through second evaporator chamber 226. In yet other exemplary embodiments, the tubing of secondary condenser 195 can be placed above evaporator 198.

When it is desired to warm second freezer compartment 182, refrigerant enters secondary condenser 195 positioned within second evaporator chamber 226 through a secondary condenser inlet 221. The refrigerant then passes through secondary condenser 195 such that heat is expelled into second evaporator chamber 226 and ultimately into second freezer compartment 182 to warm second freezer compartment 182. The refrigerant then exits secondary condenser 195 and second evaporator chamber 226 through a secondary condenser outlet 223 as shown in both FIGS. 4 and 5.

As further shown in FIGS. 3, 4, and 5, for this embodiment, refrigerator appliance 100 further includes a condenser shutoff valve 214 for selectively allowing a fluid flow through secondary condenser 195. When it is desired to maintain second freezer compartment 182 at a conventional freezer temperature (e.g., 0° F.), condenser shutoff valve 214 is articulated to a closed position to prevent refrigerant from flowing into secondary condenser 195. In this manner, secondary condenser 195 does not expel heating into second freezer compartment 182. When it is desired to convert second freezer compartment 182 into a warmed compartment, condenser shutoff valve 214 is articulated to an open position to allow refrigerant to flow into secondary condenser 195. In this way, secondary condenser 195 expels heat into second evaporator chamber 226 and second freezer compartment 182, thereby warming second freezer compartment 182. In some embodiments, condenser shutoff valve 214 can be a condenser three way valve 214*a* (FIG. 10). In such embodiments, the same refrigerant control can be accomplished by using condenser three way valve 214*a* (FIG. 10) instead of the exemplary two way condenser shutoff valve 214 shown in FIG. 4.

As shown in FIG. 4, controller 144 is communicatively coupled with condenser shutoff valve 214. When a user selects a set point temperature indicative of a conventional freezer temperature, controller 144 can send one or more signals and condenser shutoff valve 214 can receive the one or more signals to close condenser shutoff valve 214. Based at least in part on these signals, condenser shutoff valve 214 can be articulated to a closed position. In contrast, when a user selects a set point temperature indicative of any non-conventional freezer temperature (e.g., a relatively high temperature of 55° F.), controller 144 can send one or more signals and condenser shutoff valve 214 can receive the one or more signals to open condenser shutoff valve 214. Based at least in part on these signals, condenser shutoff valve 214 can be articulated to an open position. In this way, condenser shutoff valve 214 can be articulated between the open and closed positions such that a selected set point temperature can be achieved within second freezer compartment 182. It should be noted that condenser shutoff valve 214 can be articulated to positions other than the fully open position and the closed position in situations where the desired stabilized compartment temperature is different than the temperature achieved with the valve fully open or closed. Those skilled in the art will recognize suitable means for controlling such condenser shutoff valve 214 to such an intermediate open position. Likewise, condenser three way shutoff valve 214*a* can be employed and controlled to an intermediate position as well (FIG. 10).

Moreover, when evaporator shutoff valve 212 is actuated to a closed position by controller 144, condenser shutoff valve 214 is actuated to an open position based at least in part on one or more signals received from controller 144. When condenser shutoff valve 214 is actuated to a closed position, evaporator shutoff valve 212 is actuated to an open position based at least in part on one or more signals received from controller 144. It will be appreciated that it is generally undesirable to both heat and cool a compartment simultaneously. It should be noted that evaporator shutoff valve 212 can be articulated to positions other than the fully open position and the closed position in situations where the desired stabilized compartment temperature is different than the temperature achieved with the valve fully open or closed. Those skilled in the art will recognize suitable means for controlling such evaporator shutoff valve 212 to such an intermediate open position. Likewise, evaporator three way shutoff valve 212*a* can be employed and controlled to an intermediate position as well.

As further shown in FIG. 4, sealed system 190 can further include a heating element 197 positioned downstream of primary condenser 194. Heating element 197 can be a condenser loop used as an "anti-sweat" or anti-condensation system for refrigerator appliance 100. This loop, in practice, is functionally a "hot liquid loop", however, it has sometimes is referred to as a "hot gas loop" by those skilled in the art. Heating element 197 is in fluid communication with primary condenser 194 via a heating element inlet conduit 215. When refrigerant flows through heating element 197, heating element 197 expels heat to warm various surfaces of refrigerator appliance 100 to prevent condensation from forming thereon. Refrigerant then exits heating element 197 and flows downstream via a heating element outlet conduit 216 to expansion device 196.

Referring still to FIG. 4, secondary condenser 195 can be positioned along a secondary condenser loop 217. Secondary condenser loop 217 is in fluid communication with heating element inlet conduit 215 at a loop inlet 218 positioned downstream of primary condenser 194 and upstream of heating element 197. Secondary condenser loop 217 is also in fluid communication with heating element outlet conduit 216 at a loop outlet 219 as shown. Condenser shutoff valve 214 is positioned between secondary condenser 195 and loop inlet 218 along secondary condenser loop 217. In this way, secondary condenser 195 is connected with heating element 197 in parallel. When condenser shutoff valve 214 is articulated to a closed position by controller 144, refrigerant flows only through heating element 197. When condenser shutoff valve 214 is articulated to an open position by controller 144, refrigerant flows through both secondary condenser 195 and heating element 197. In this manner, second freezer compartment 182 is warmed by secondary condenser 195 and condensation buildup is prevented by heating element 197.

Figure 9:
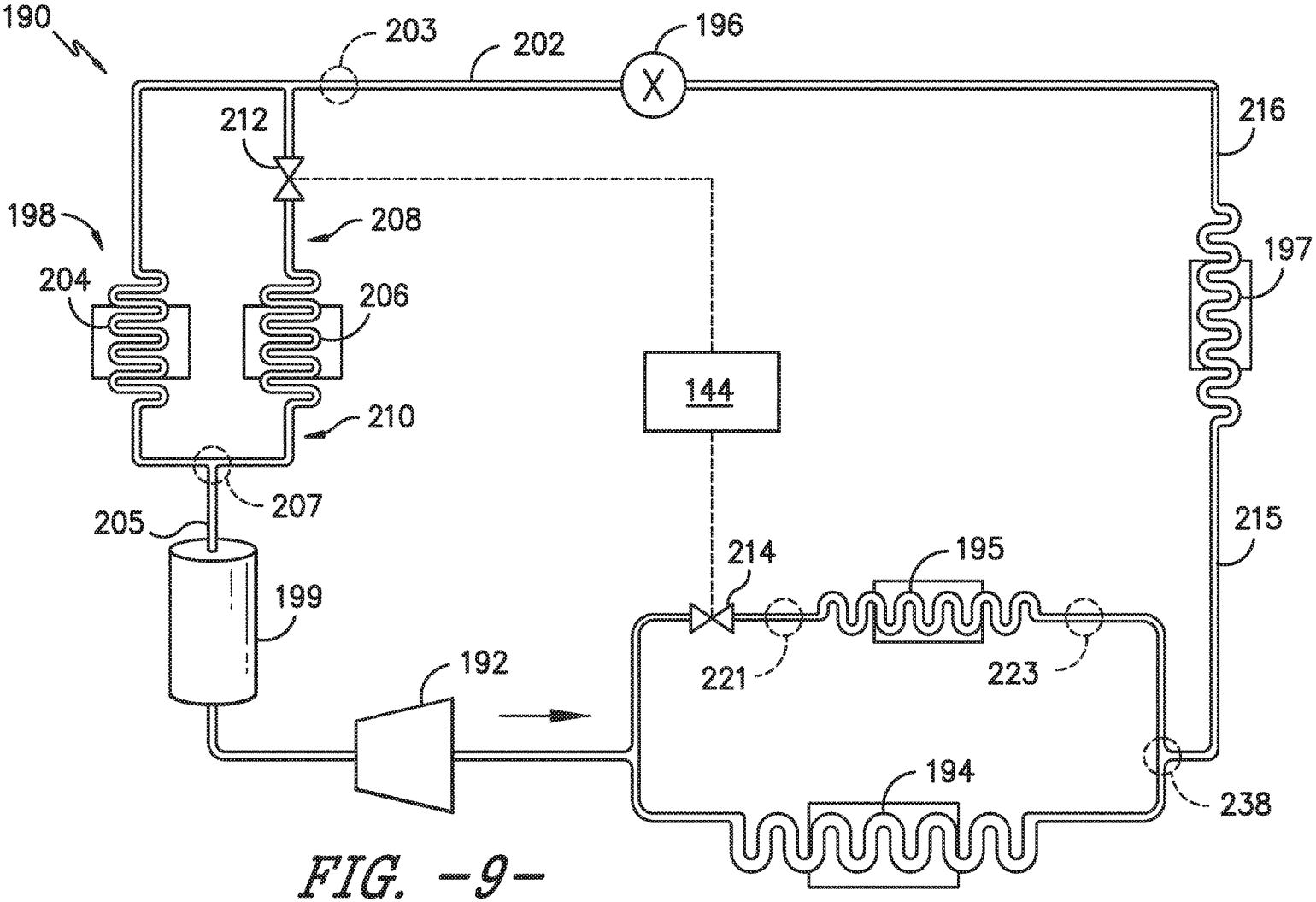
FIG. 9 provides a schematic view of another exemplary embodiment of sealed system configured for conditioning the exemplary freezer chamber of the exemplary refrigerator appliance of FIG. 1.

FIG. 9 provides a schematic view of another exemplary embodiment of sealed system 190 configured for conditioning freezer chamber 124 of the exemplary refrigerator appliance 100 of FIG. 1. For this embodiment, as shown in FIG. 9, condenser shutoff valve 214 is positioned upstream of main condenser 194 and is configured to selectively allow a flow of fluid to secondary condenser 195 (i.e., by opening or closing the valve). Condenser shutoff valve 214 is controlled by controller 144 to provide the desired heating for second freezer compartment 182 via secondary condenser 195. The discharges of secondary condenser 195 and main condenser 194 would merge at junction 228 where the mixed flow stream would proceed to heating element 197 (i.e., the hot gas loop).

Returning to FIGS. 3, 4, and 5, as shown particularly in FIG. 5, for this embodiment, condenser shutoff valve 214 is not positioned within second evaporator chamber 226. In this way, refrigerant is prevented from flowing into second freezer compartment 182 through secondary condenser 195 when condenser shutoff valve 214 is in a closed position. When it is desired to maintain second freezer compartment 182 at conventional freezer temperatures, this prevents inadvertent warming of second freezer compartment 182 when second evaporator section 206 is being used to cool second freezer compartment 182. In some embodiments, condenser shutoff valve 214 is positioned within second evaporator chamber 226. In such embodiments, condenser shutoff valve 214 is positioned proximate condenser inlet 221 so as to reduce the amount of refrigerant entering second freezer compartment 182 through secondary condenser 195.

In some embodiments, secondary condenser 195 and condenser shutoff valve 212 are not included in sealed system 190. In such embodiments, when a user selects a set point temperature indicative of a conventional freezer temperature, controller 144 can send one or more signals and evaporator shutoff valve 212 can receive the one or more signals to open evaporator shutoff valve 212. Based at least in part on these signals, evaporator shutoff valve 212 can be articulated to an open position thereby chilling second freezer compartment 182 to conventional freezer temperatures. In contrast, when a user selects a set point temperature indicative of any non-conventional freezer temperature (e.g., a relatively high temperature of 55° F.), controller 144 can send one or more signals and evaporator shutoff valve 212 can receive the one or more signals to close evaporator shutoff valve 212. Based at least in part on these signals, evaporator shutoff valve 212 can be articulated to a closed position. In this way, the relatively warm selected set point temperature can be achieved within second freezer compartment 182 via a natural warming process. Refrigerator appliance 100 can be designed such that the desired temperature in second freezer compartment 182 can be achieved, within reason, by passive means. In such embodiments, heat can be designed to leak into second freezer compartment 182 to provide natural warming of second freezer compartment 182. By tailoring the heat leakage into second freezer compartment 182, the desired set point temperature can be achieved. Moreover, in such embodiments, controller 144 can be communicatively coupled with second fan 242 and supply and return dampers 244, 246. The controller 144 can cease operation of second fan 242 and can close dampers 244, 246 to prevent inadvertent cooling of the second freezer compartment 182.

Figure 6:
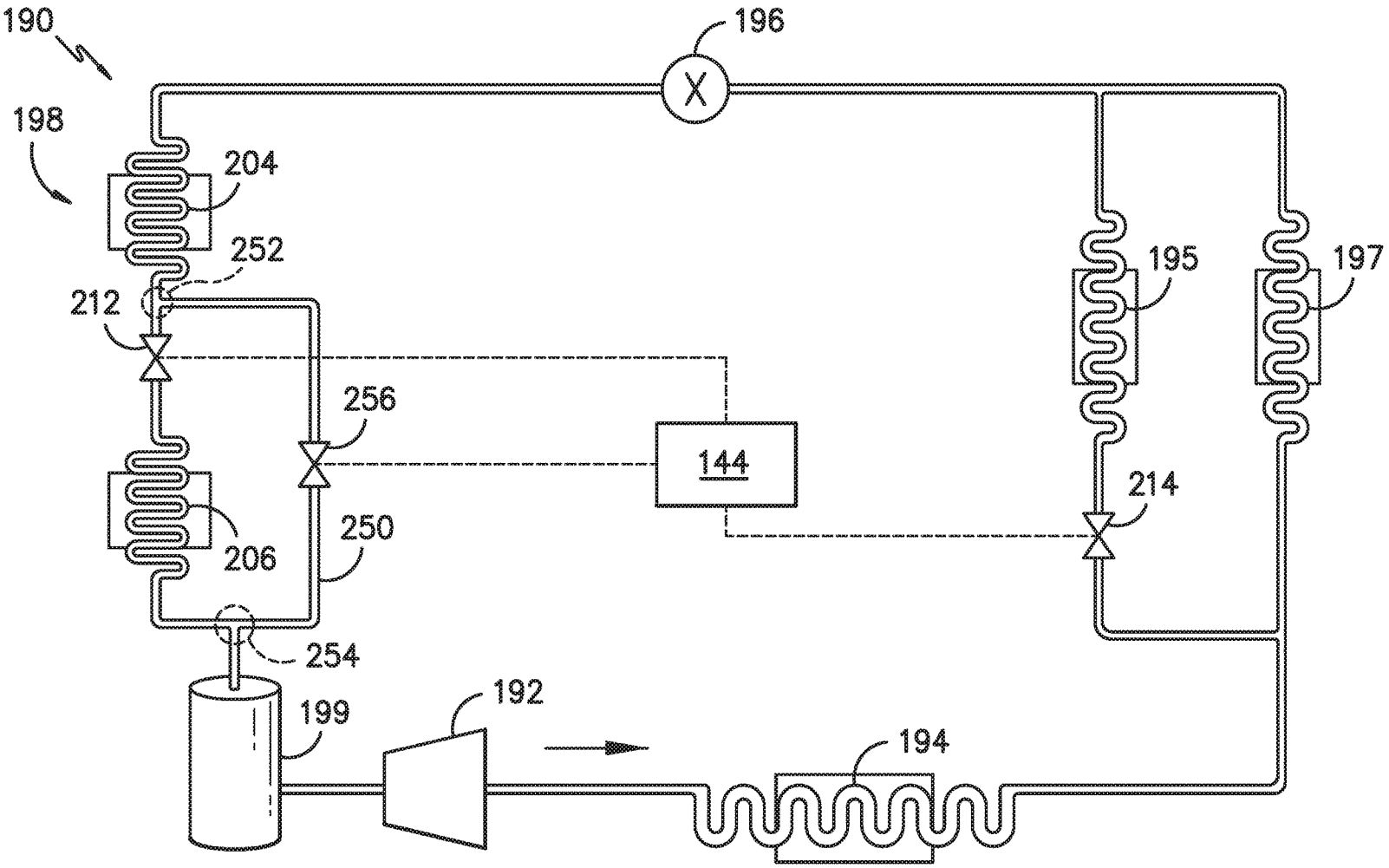
FIG. 6 provides a schematic view of another exemplary embodiment of sealed system configured for conditioning the exemplary freezer chamber of the exemplary refrigerator appliance of FIG. 1.

FIG. 6 provides a schematic view of another exemplary embodiment of sealed system 190 configured for use with freezer chamber 124 of exemplary refrigerator appliance 100 of FIG. 1. More particularly, in FIG. 6, first evaporator section 204 and second evaporator section 206 are connected in series. Like reference numerals will be used in FIG. 6 to refer to the same or similar features of the embodiment of FIGS. 1-5.

As shown in FIG. 6, for this embodiment, sealed system 190 includes an evaporator bypass loop 250 in fluid communication with evaporator 198 at a bypass inlet 252 positioned upstream of evaporator shutoff valve 212 and downstream of first evaporator section 204. Evaporator bypass loop 250 is also in fluid communication with evaporator 198 at a bypass outlet 254 positioned upstream of accumulator 199 and downstream of second evaporator section 206. A bypass evaporator shutoff valve 256 is positioned along evaporator bypass loop 250 for selectively allowing a fluid flow through evaporator bypass loop 250.

As further depicted in FIG. 6, bypass evaporator shutoff valve 256 is communicatively coupled with controller 144, as is evaporator shutoff valve 212 and condenser shutoff valve 214 as shown. When a user selects a set point temperature indicative of a conventional freezer temperature for second freezer compartment 182, controller 144 can send one or more signals and evaporator shutoff valve 212, bypass shutoff valve 256, and condenser shutoff valve 214 can each receive the one or more signals. Based at least in part on these signals, evaporator shutoff valve 212 can be articulated to an open position, bypass evaporator shutoff valve 256 can be articulated to a closed position such that refrigerant flows through second evaporator section 206, and condenser shutoff valve 214 is likewise articulated to the closed position. In contrast, when a user selects a set point temperature indicative of any non-conventional freezer temperature (e.g., a relatively high temperature of 55° F.), controller 144 can send one or more signals and evaporator shutoff valve 212, bypass evaporator shutoff valve 256, and condenser shutoff valve 214 can each receive the one or more signals. Based at least in part on these signals, evaporator shutoff valve 212 can be articulated to a closed position to prevent inadvertent cooling of the second freezer compartment 182, bypass evaporator shutoff valve 256 can be articulated to an open position to allow a fluid flow (i.e. refrigerant) through evaporator bypass loop 250, and condenser shutoff valve 214 is likewise articulated to an open position in order to warm second freezer compartment 182 to the desired set point temperature.

Figure 7:
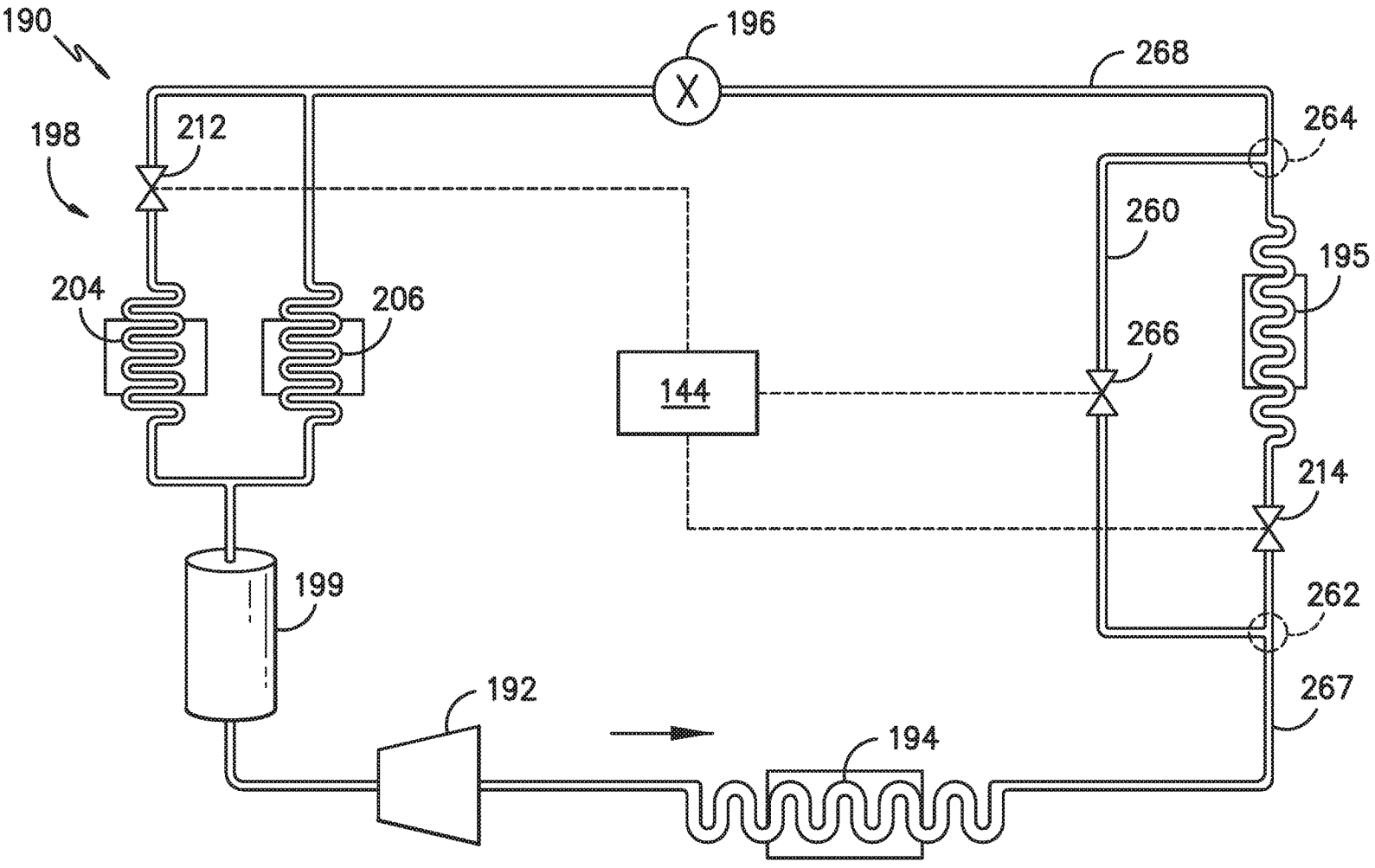
FIG. 7 provides a schematic view of yet another exemplary embodiment of sealed system configured for conditioning the exemplary freezer chamber of the exemplary refrigerator appliance of FIG. 1.

FIG. 7 provides a schematic view of yet another sealed system configured for conditioning the exemplary freezer chamber of the exemplary refrigerator appliance of FIG. 1 according to an exemplary embodiment of the present subject matter. Like reference numerals will be used in FIG. 7 to refer to the same or similar features of the embodiment of FIGS. 1-5. For this embodiment, sealed system 190 does not include heating element 197. In such an embodiment, as shown, primary condenser 194 and secondary condenser 195 can be connected in series.

More particularly, for this embodiment, sealed system 190 includes a condenser bypass loop 260 in fluid communication with a secondary condenser inlet conduit 267 at a bypass inlet 262 positioned upstream of secondary condenser 195 and downstream of primary condenser 194. Condenser bypass loop 260 is also in fluid communication with a secondary condenser outlet conduit 268 at a bypass outlet 264 positioned upstream of expansion device 196 and downstream of secondary condenser 195. A bypass condenser shutoff valve 266 is positioned along condenser bypass loop 260 for selectively allowing a fluid flow through condenser bypass loop 260.

As further depicted in FIG. 7, condenser bypass shutoff valve 266 is communicatively coupled with controller 144, as is evaporator shutoff valve 212 and condenser shutoff valve 214 as shown. When a user selects a set point temperature indicative of a conventional freezer temperature for second freezer compartment 182, controller 144 can send one or more signals and evaporator shutoff valve 212, condenser bypass shutoff valve 266, and condenser shutoff valve 214 can each receive the one or more signals. Based at least in part on these signals, evaporator shutoff valve 212 can be articulated to an open position, condenser bypass shutoff valve 266 can likewise be articulated to an open position to allow a fluid flow through condenser bypass loop 260, and condenser shutoff valve 214 is articulated to the closed position to ensure second freezer compartment 182 is not heated while also being cooled. In contrast, when a user selects a set point temperature indicative of any non-conventional freezer temperature (e.g., a relatively high temperature of 55° F.), controller 144 can send one or more signals and evaporator shutoff valve 212, condenser bypass shutoff valve 266, and condenser shutoff valve 214 can each receive the one or more signals. Based at least in part on these signals, evaporator shutoff valve 212 can be articulated to a closed position to prevent inadvertent cooling of second freezer compartment 182, bypass condenser shutoff valve 266 can likewise be articulated to a closed position to prevent fluid flow through condenser bypass loop 260, and condenser shutoff valve 214 is articulated to an open position in order to warm second freezer compartment 182 to the desired set point temperature.

Figure 11:
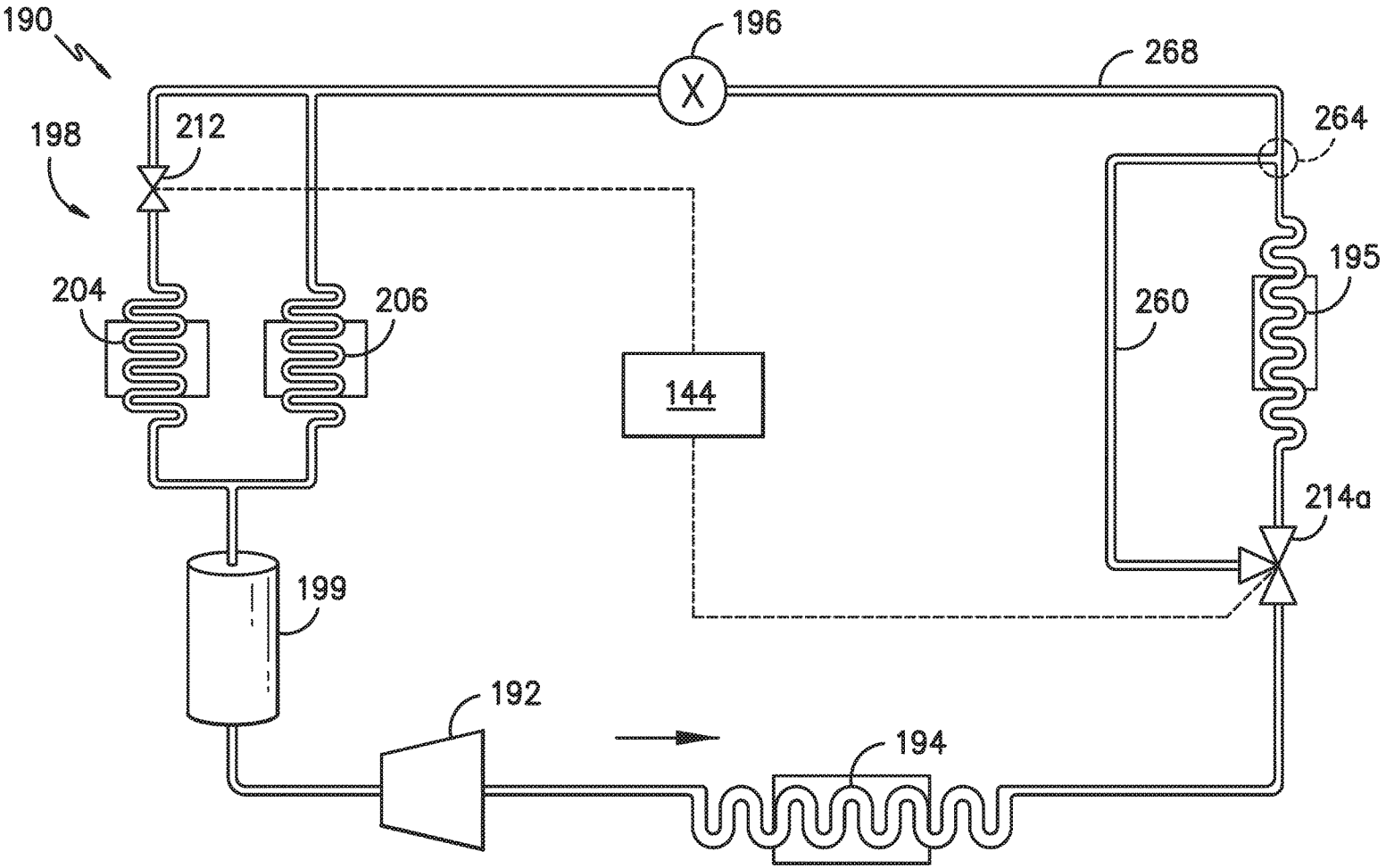
FIG. 11 provides a schematic view of yet another exemplary embodiment of sealed system configured for conditioning the exemplary freezer chamber of the exemplary refrigerator appliance of FIG. 1.

In some embodiments, as shown in FIG. 11, condenser shutoff valve 214 and condenser bypass shutoff valve 266 are combined into condenser three way valve 214*a*. In such embodiments, condenser three way shutoff valve 214*a* is configured to selectively allow a flow of fluid (i.e., refrigerant) through condenser bypass loop 260 or through secondary condenser 195 depending on the selected set point temperature of second freezer compartment 182.

Figure 8:
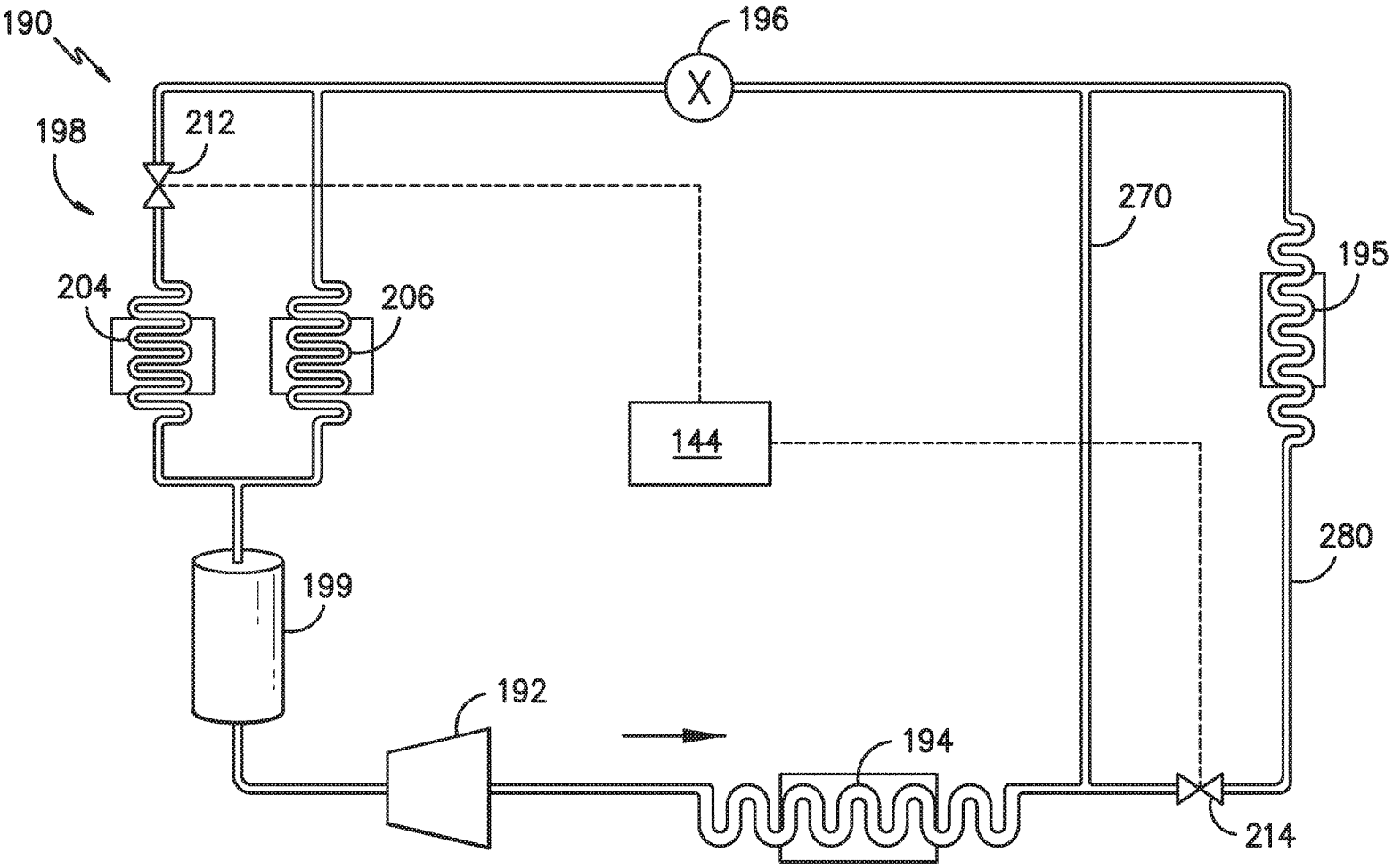
FIG. 8 provides a schematic view of another exemplary embodiment of sealed system configured for conditioning the exemplary freezer chamber of the exemplary refrigerator appliance of FIG. 1.

FIG. 8 provides a schematic view of another embodiment of sealed system 190 configured for conditioning freezer chamber 124 of the exemplary refrigerator appliance of FIG. 1 according to an exemplary embodiment of the present subject matter. Like reference numerals will be used in FIG. 8 to refer to the same or similar features of the embodiment of FIGS. 1-5. For this embodiment, sealed system 190 does not include heating element 197. In such an embodiment, as shown, primary condenser 194 and secondary condenser 195 can be connected in parallel.

For this embodiment, when a user selects a set point temperature indicative of a conventional freezer temperature for second freezer compartment 182, controller 144 can send one or more signals and evaporator shutoff valve 212 and condenser shutoff valve 214 can each receive the one or more signals. Based at least in part on these signals, evaporator shutoff valve 212 can be articulated to an open position, and in contrast, condenser shutoff valve 214 is articulated to the closed position to ensure second freezer compartment 182 is not heated while also being cooled. Thus, as shown, refrigerant exiting primary condenser 194 is routed downstream along an expansion device inlet conduit 270 directly to expansion device 196.

In contrast, when a user selects a set point temperature indicative of any non-conventional freezer temperature (e.g., a relatively high temperature of 55° F.), controller 144 can send one or more signals and evaporator shutoff valve 212 and condenser shutoff valve 214 can each receive the one or more signals. Based at least in part on these signals, evaporator shutoff valve 212 can be articulated to a closed position to prevent inadvertent cooling of second freezer compartment 182 and condenser shutoff valve 214 is articulated to an open position in order to warm second freezer compartment 182 to the desired set point temperature. Accordingly, as shown in FIG. 8, refrigerant exiting primary condenser 194 can be routed along a secondary condenser loop 280 such that the refrigerant can pass through secondary condenser 195 for warming second freezer compartment 182.

Figure 12:
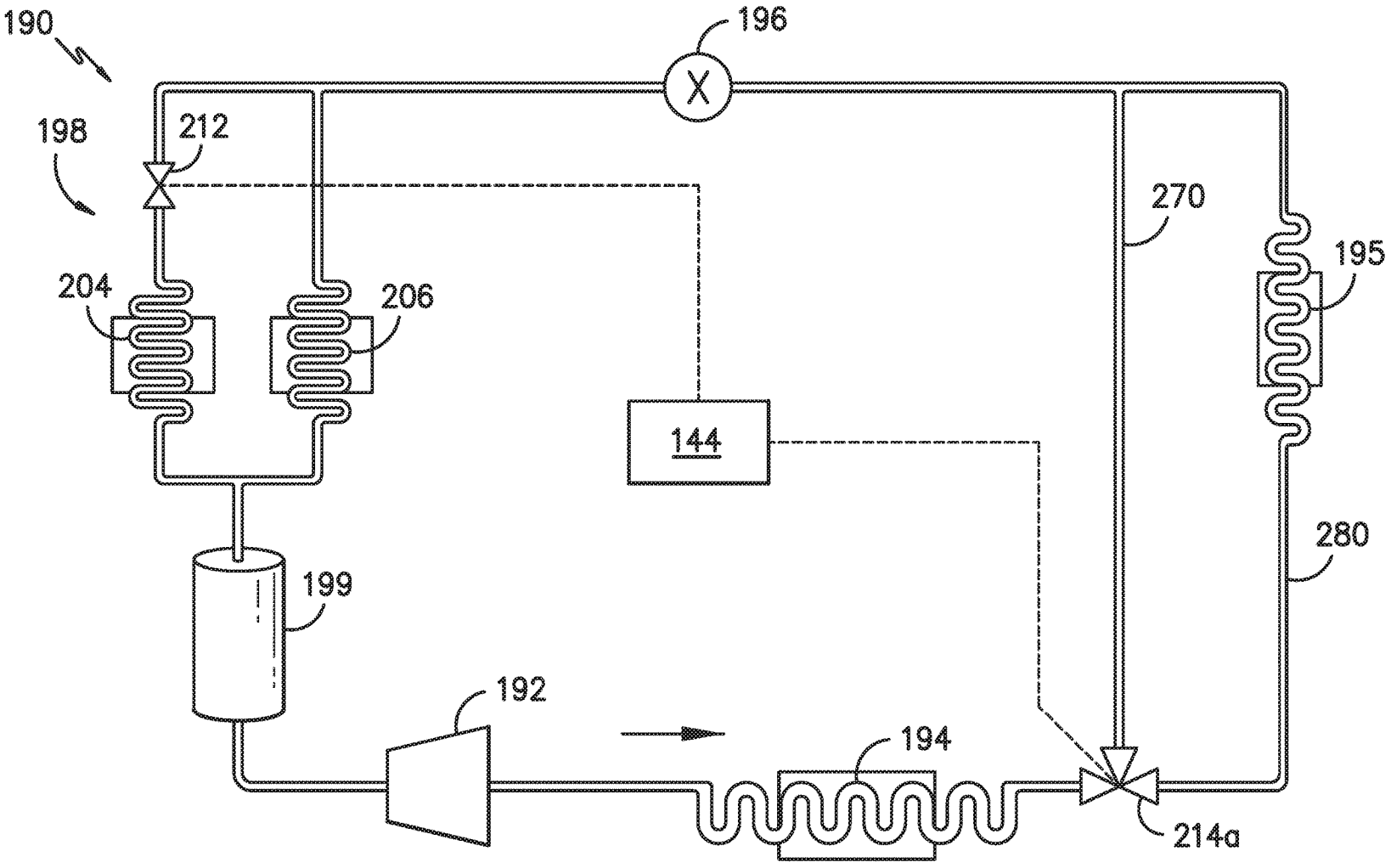
FIG. 12 provides a schematic view of another exemplary embodiment of sealed system configured for conditioning the exemplary freezer chamber of the exemplary refrigerator appliance of FIG. 1.

In some embodiments, as shown in FIG. 12, condenser shutoff valve 214 is condenser three way valve 214*a*. In such embodiments, condenser three way shutoff valve 214*a* is configured to selectively allow a flow of fluid (i.e., refrigerant) through expansion device inlet conduit 270 or through secondary condenser loop 280 and through secondary condenser 195 depending on the selected set point temperature of second freezer compartment 182.

Using the features described above, refrigerator appliance 100 is able to maintain first freezer compartment 180 at a fixed, relatively low temperature (e.g., around 0° F.), while allowing second freezer compartment 182 to be selectively adjusted anywhere between the freezer temperature and relatively high temperatures (e.g., between around 0° F. and 55° F.). Moreover, utilizing exemplary embodiments of sealed system 190 described herein, overall system efficiency may be gained due to the increased condensing heat exchange area.

It will be appreciated in some exemplary embodiments that first freezer compartment 180 can be the "convertible" freezer chamber compartment capable of being selectively adjusted anywhere between the freezer temperature and relatively high temperatures (e.g., between around 0° F. and 55° F.) while second freezer compartment 182 can be maintained at a fixed, relatively low temperature (e.g., around 0° F.). Stated alternatively, first freezer compartment 180 can be configured in the same or similar manner as second freezer compartment 182 as disclosed herein and second freezer compartment 182 can be configured in the same or similar manner to that of first freezer compartment 180 as disclosed herein.

It will further be appreciated that although certain types of valves are shown in the figures and described herein, that the valves disclosed and illustrated herein can be any suitable type of valve and still be within the spirit and scope present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet comprising an inner liner defining a freezer chamber having a first freezer compartment and a second freezer compartment;

a first evaporator cover positioned within the first freezer compartment to define a first evaporator chamber;

a second evaporator cover positioned within the second freezer compartment to define a second evaporator chamber;

an evaporator including a first evaporator section and a second evaporator section, the first evaporator section positioned in the first evaporator chamber and the second evaporator section positioned in the second evaporator chamber; and an evaporator shutoff valve positioned along at least one of the first evaporator section or the second evaporator section for selectively allowing fluid communication between the first evaporator section and the second evaporator section.

2. The refrigerator appliance of claim 1, wherein the refrigerator appliance further comprises:

a secondary condenser positioned in at least one of the first evaporator chamber and the second evaporator chamber; and a condenser shutoff valve for selectively allowing a fluid flow through the secondary condenser.

3. The refrigerator appliance of claim 2, wherein the evaporator shutoff valve is an evaporator three way shutoff valve and the condenser shutoff valve is a condenser three way shutoff valve.

4. The refrigerator appliance of claim 2, wherein the refrigerator appliance further comprises:

a controller communicatively coupled with the evaporator shutoff valve and the condenser shutoff valve;

wherein the evaporator shutoff valve is actuated to a closed position when the condenser shutoff valve is actuated to an open position based at least in part on one or more signals received from the controller and the condenser shutoff valve is actuated to a closed position when the evaporator shutoff valve is actuated to an open position based at least in part on one or more signals received from the controller.

5. The refrigerator appliance of claim 1, and wherein the refrigerator appliance further comprises:

a controller communicatively coupled with the evaporator shutoff valve for selectively actuating the evaporator shutoff valve between an open position and a closed position.

6. The refrigerator appliance of claim 1, wherein the refrigerator appliance further comprises:

an evaporator inlet conduit in fluid communication with the evaporator via an evaporator inlet, and wherein the evaporator shutoff valve is positioned within the same evaporator chamber as the evaporator inlet.

7. The refrigerator appliance of claim 1, wherein the refrigerator appliance further comprises:

an evaporator inlet conduit in fluid communication with the evaporator via an evaporator inlet; and an evaporator outlet conduit in fluid communication with the evaporator via an evaporator outlet;

wherein the evaporator inlet is positioned within the same evaporator chamber as the evaporator outlet.

8. The refrigerator appliance of claim 1, wherein the refrigerator appliance further comprises:

an evaporator inlet conduit in fluid communication with the evaporator at an evaporator inlet; and an evaporator outlet conduit in fluid communication with the evaporator at an evaporator outlet;

wherein the evaporator shutoff valve is positioned within the same evaporator chamber as the evaporator inlet and the evaporator outlet.

9. The refrigerator appliance of claim 1, wherein the first evaporator section and the second evaporator section are in fluid communication in parallel.

10. The refrigerator appliance of claim 1, wherein the first evaporator section and the second evaporator section are in fluid communication in series, and wherein the refrigerator appliance further comprises:

a compressor;

an accumulator positioned downstream of the evaporator and upstream of the compressor;

an evaporator bypass loop in fluid communication with the evaporator at a bypass inlet positioned upstream of the evaporator shutoff valve and downstream of the first evaporator section and in fluid communication with the evaporator at a bypass outlet positioned upstream of the accumulator and downstream of the second evaporator section;

a bypass evaporator shutoff valve positioned along the evaporator bypass loop for selectively allowing a fluid flow through the evaporator bypass loop.

11. The refrigerator appliance of claim 10, wherein the refrigerator appliance further comprises:

a controller communicatively coupled with the evaporator shutoff valve and the bypass evaporator shutoff valve;

wherein the evaporator shutoff valve is actuated to a closed position when the bypass evaporator shutoff valve is actuated to an open position based at least in part on one or more signals received from the controller and the bypass evaporator shutoff valve is actuated to a closed position when the evaporator shutoff valve is actuated to an open position based at least in part on one or more signals received from the controller.

12. The refrigerator appliance of claim 1, wherein the first evaporator section and the second evaporator section are coupled by a first transition conduit extending through the mullion, and wherein the evaporator inlet is positioned in the first evaporator chamber and the evaporator shutoff valve is positioned in the second evaporator chamber along the second evaporator section; and wherein the evaporator shutoff valve is positioned proximate the first transition conduit.

13. A refrigerator appliance defining a vertical direction, a lateral direction, and a transverse direction, the vertical, lateral, and transverse directions being mutually perpendicular, the refrigerator appliance comprising:

a cabinet comprising an inner liner defining a freezer chamber having a first freezer compartment and a second freezer compartment;

a first evaporator cover positioned within the first freezer compartment to define a first evaporator chamber;

a second evaporator cover positioned within the second freezer compartment to define a second evaporator chamber;

an evaporator including a first evaporator section and a second evaporator section, the first evaporator section positioned in the first evaporator chamber and the second evaporator section positioned in the second evaporator chamber; and an evaporator shutoff valve positioned along at least one of the first evaporator section or the second evaporator section for selectively allowing fluid communication between the first evaporator section and the second evaporator section;

a secondary condenser positioned in at least one of the first evaporator chamber and the second evaporator chamber; and a condenser shutoff valve for selectively allowing a fluid flow through the secondary condenser.

14. The refrigerator appliance of claim 13, wherein the refrigerator appliance further comprises:

a controller communicatively coupled with the evaporator shutoff valve and the condenser shutoff valve;

wherein the evaporator shutoff valve is actuated to a closed position when the condenser shutoff valve is actuated to an open position based at least in part on one or more signals received from the controller and the condenser shutoff valve is actuated to a closed position when the evaporator shutoff valve is actuated to an open position based at least in part on one or more signals received from the controller.

15. The refrigerator appliance of claim 13, wherein the refrigerator appliance further comprises:

a primary condenser;

a heating element inlet conduit in fluid communication with the primary condenser;

a heating element positioned downstream of the primary condenser and in fluid communication with the primary condenser via the heating element inlet conduit;

a heating element outlet conduit in fluid communication with the heating element and positioned downstream of the heating element;

a secondary condenser loop in fluid communication with the heating element inlet conduit at a loop inlet positioned upstream of the heating element and downstream of the primary condenser and the secondary condenser loop in fluid communication with the heating element outlet conduit at a loop outlet, the secondary condenser positioned along the secondary condenser loop;

wherein the condenser shutoff valve is positioned between the secondary condenser and the loop inlet along the secondary condenser loop.

16. The refrigerator appliance of claim 13, wherein the secondary condenser is positioned along a back wall of the inner liner behind one of the first and second evaporator sections.

17. The refrigerator appliance of claim 13, wherein the secondary condenser is a spine fin coil extending at least partially through at least one of the first evaporator chamber and the second evaporator chamber.

18. The refrigerator appliance of claim 13, wherein the refrigerator appliance further comprises:

an evaporator inlet conduit in fluid communication with the evaporator via an evaporator inlet; and an evaporator outlet conduit in fluid communication with the evaporator via an evaporator outlet;

wherein the evaporator shutoff valve is positioned within the same evaporator chamber as the evaporator inlet and the evaporator outlet.

19. The refrigerator appliance of claim 13, wherein the evaporator shutoff valve is an evaporator three way shutoff valve and the condenser shutoff valve is a condenser three way shutoff valve.

* * * * *